US010716373B2

(12) United States Patent
Truong et al.

(10) Patent No.: US 10,716,373 B2
(45) Date of Patent: Jul. 21, 2020

(54) FOLDABLE UMBRELLA WITH DYNAMIC RIB STRUCTURE

(71) Applicant: HEDGEHOG PRODUCTS INC., Kitchener (CA)

(72) Inventors: Kevin Paul Truong, Mississauga (CA); Cahay Ho, St. Albert (CA)

(73) Assignee: HEDGEHOG PRODUCTS INC., Kitchener, Ontario (CA)

( * ) Notice: Subject to any disclaimer, the term of this patent is extended or adjusted under 35 U.S.C. 154(b) by 0 days.

(21) Appl. No.: 16/327,373

(22) PCT Filed: Aug. 21, 2017

(86) PCT No.: PCT/CA2017/050989

§ 371 (c)(1),
(2) Date: Feb. 22, 2019

(87) PCT Pub. No.: WO2018/035605

PCT Pub. Date: Mar. 1, 2018

(65) Prior Publication Data

US 2019/0216188 A1 Jul. 18, 2019

Related U.S. Application Data

(60) Provisional application No. 62/378,302, filed on Aug. 23, 2016.

(51) Int. Cl.

| | |
|---|---|
| ***A45B 25/22*** | (2006.01) |
| ***A45B 25/06*** | (2006.01) |
| ***A45B 25/10*** | (2006.01) |
| ***A45B 19/10*** | (2006.01) |
| *A45B 19/00* | (2006.01) |
| *A45B 25/02* | (2006.01) |

(52) U.S. Cl.

CPC ..... *A45B 25/22* (2013.01); *A45B 19/10* (2013.01); *A45B 25/06* (2013.01); *A45B 25/10* (2013.01); *A45B 19/00* (2013.01); *A45B 25/02* (2013.01)

(58) Field of Classification Search

CPC ..... A45B 25/06; A45B 25/08; A45B 25/10; A45B 25/22

See application file for complete search history.

(56) References Cited

U.S. PATENT DOCUMENTS 5,329,953 A * 7/1994 Becher ..... A45B 19/04 135/31
5,386,842 A * 2/1995 Becher ..... A45B 23/00 135/20.3

(Continued)

FOREIGN PATENT DOCUMENTS

FR 539585 A * 6/1922 ..... A45B 25/06

*Primary Examiner* — David R Dunn
*Assistant Examiner* — Danielle Jackson
(74) *Attorney, Agent, or Firm* — Gowling WLG (Canada) LLP; Jeffrey W. Wong

(57) ABSTRACT

The disclosure is directed at an umbrella including a canopy having a set of canopy portions; and a frame portion comprising a shaft portion; a sliding collar assembly coupled to the shaft portion and sliding along the shaft portion; and a set of ribs, each of the independent ribs attached to one of the set of canopy portions and to the sliding collar assembly, where each of the set of ribs move independently of each other when a high wind force is experienced by one of the canopy portions.

12 Claims, 17 Drawing Sheets

(56) References Cited

U.S. PATENT DOCUMENTS

| | | | | |
|---|---|---|---|---|
| 5,752,534 | A * | 5/1998 | Becher | A45B 23/00 135/15.1 |
| 6,173,723 | B1 * | 1/2001 | Wang | A45B 25/22 135/27 |
| 6,571,813 | B2 * | 6/2003 | Lin | A45B 19/04 135/28 |
| 6,736,151 | B2 * | 5/2004 | Lin | A45B 25/22 135/22 |
| 7,318,443 | B1 * | 1/2008 | Ma | A45B 25/06 135/20.3 |
| 7,481,232 | B2 * | 1/2009 | Apple | A45B 23/00 135/16 |
| 7,980,262 | B1 * | 7/2011 | You | A45B 25/02 135/32 |
| 8,607,808 | B1 * | 12/2013 | You | A45B 25/22 135/25.33 |
| 9,788,617 | B1 * | 10/2017 | Chen | A45B 25/02 |
| 2002/0129843 | A1 * | 9/2002 | Wang | A45B 25/02 135/29 |
| 2005/0081902 | A1 * | 4/2005 | Liu | A45B 25/08 135/78 |
| 2005/0236024 | A1 * | 10/2005 | Wu | A45B 25/22 135/27 |
| 2011/0108074 | A1 * | 5/2011 | You | A45B 25/10 135/20.1 |
| 2012/0073617 | A1 * | 3/2012 | Kupferman | A45B 25/08 135/20.3 |

* cited by examiner

FOLDABLE UMBRELLA WITH DYNAMIC RIB STRUCTURE

CROSS-REFERENCE TO OTHER APPLICATIONS

This application is a formal application based on and claiming the benefit of U.S. provisional application No. 62/378,302, filed Aug. 23, 2016, which is hereby incorporated herein by reference.

FIELD OF THE DISCLOSURE

The present disclosure relates to umbrellas. More particularly, the present disclosure relates to a foldable wind-resistant umbrella.

BACKGROUND OF THE DISCLOSURE

Folding umbrellas are generally susceptible to flipping inside out against wind, which can damage the umbrella. Wind acting upon the material of the umbrella canopy can force the umbrella to flip inside out and damage the frame structure of the umbrella due to wind forces being transferred from the umbrella canopy material to the ribs and the frame of the umbrella. The wind forces cause the ribs of the umbrella to bend and the frame to flip inside out, which can permanently damage the umbrella.

Various solutions have been proposed to create umbrellas that are not damaged when opened in high wind conditions. Such solutions include: improving the rigidity of the ribs of the umbrella through geometry and material selection; incorporating a spring system into the ribs; and utilizing a canopy venting system. Although these solutions decrease the likelihood that the umbrella will invert when opened in high wind conditions and thus cause damage to the umbrella, such umbrellas can still invert when opened in high wind conditions. Furthermore, these solutions do not relieve stress upon the umbrella frame when opened in high wind conditions and which can result in the frame becoming permanently damaged.

Therefore, there is provided a novel foldable umbrella with dynamic rib structure.

SUMMARY OF THE DISCLOSURE

The disclosure is directed at a foldable wind-resistant umbrella with dynamic rib structure. The umbrella of the disclosure preferably increases the threshold of wind resistance, or increases the ability of the umbrella to handle unexpected or undesired wind forces. In some cases, the umbrella of the disclosure is able to divert wind as well. In one embodiment of the disclosure, the umbrella includes a canopy portion and a shaft portion connected at one end to the canopy portion. A set of ribs are connected to a collar assembly that slides up and down the shaft portion to enable the umbrella to be urged or moved between open and closed positions. Each of the set of ribs are also connected to the canopy to close the canopy when the umbrella is placed in the closed position. While the ribs move in a co-ordinated manner when the umbrella is being closed, the ribs move independent of each other. When a gust of wind is experienced with the umbrella in the open position, the independent nature of the ribs allows for the force applied to the canopy to be dissipated or in other words, raises the threshold of force necessary to cause the canopy to flip inside out.

In one aspect of the disclosure, there is provided an umbrella including a canopy having a set of canopy portions; and a frame portion including a shaft portion; a sliding collar assembly coupled to the shaft portion and sliding along the shaft portion; and a set of ribs, each of the independent ribs attached to one of the set of canopy portions and to the sliding collar assembly, where each of the set of ribs move independently of each other when a high wind force is experienced by one of the canopy portions.

In another aspect, each of the ribs includes a primary section having an inner end and an outer end; a middle section; an end section; and a support stretcher connected at one end to the primary section of the rib and at a second end to the sliding collar assembly. In a further aspect, the sliding collar assembly includes a set of guide rails; and a set of slider shuttles associated with one of the set of guide rails, each of the slider shuttles for receiving one of the support stretchers. In another aspect, the sliding collar assembly includes a top stopper plate for blocking movement of the set of sliding shuttles in an upward direction; and a bottom stopper plate for blocking movement of the set of sliding shuttles in a downward direction. In yet another embodiment, each end section of a rib includes an end tip attached to the canopy portion. In an aspect, when an undesired force is applied to one of the canopy portions, a support stretcher associated with the rib that is associated with the one of the canopy portions moves up its guide rail to accommodate the undesired force. In another aspect, ribs adjacent the canopy experiencing the applied force move up its guide rail to accommodate the undesired force.

In a further aspect, the shaft portion includes a handle portion at one end; and a rib hub at an opposite end. In one aspect, the rib hub includes a fastening mechanism for fastening the rib hub to each of the set of ribs. In another aspect, the sliding collar assembly includes a locking mechanism. In one aspect, the locking mechanism is an internal locking mechanism.

In another aspect, the set of ribs are radially disposed about the shaft portion. In a further aspect, the set of ribs are spaced an equidistance apart.

BRIEF DESCRIPTION OF THE DRAWINGS

Preferred embodiments of the present disclosure will now be described, by way of example only, with reference to the attached figures, wherein.

DETAILED DESCRIPTION OF THE DISCLOSURE

Figure 1:
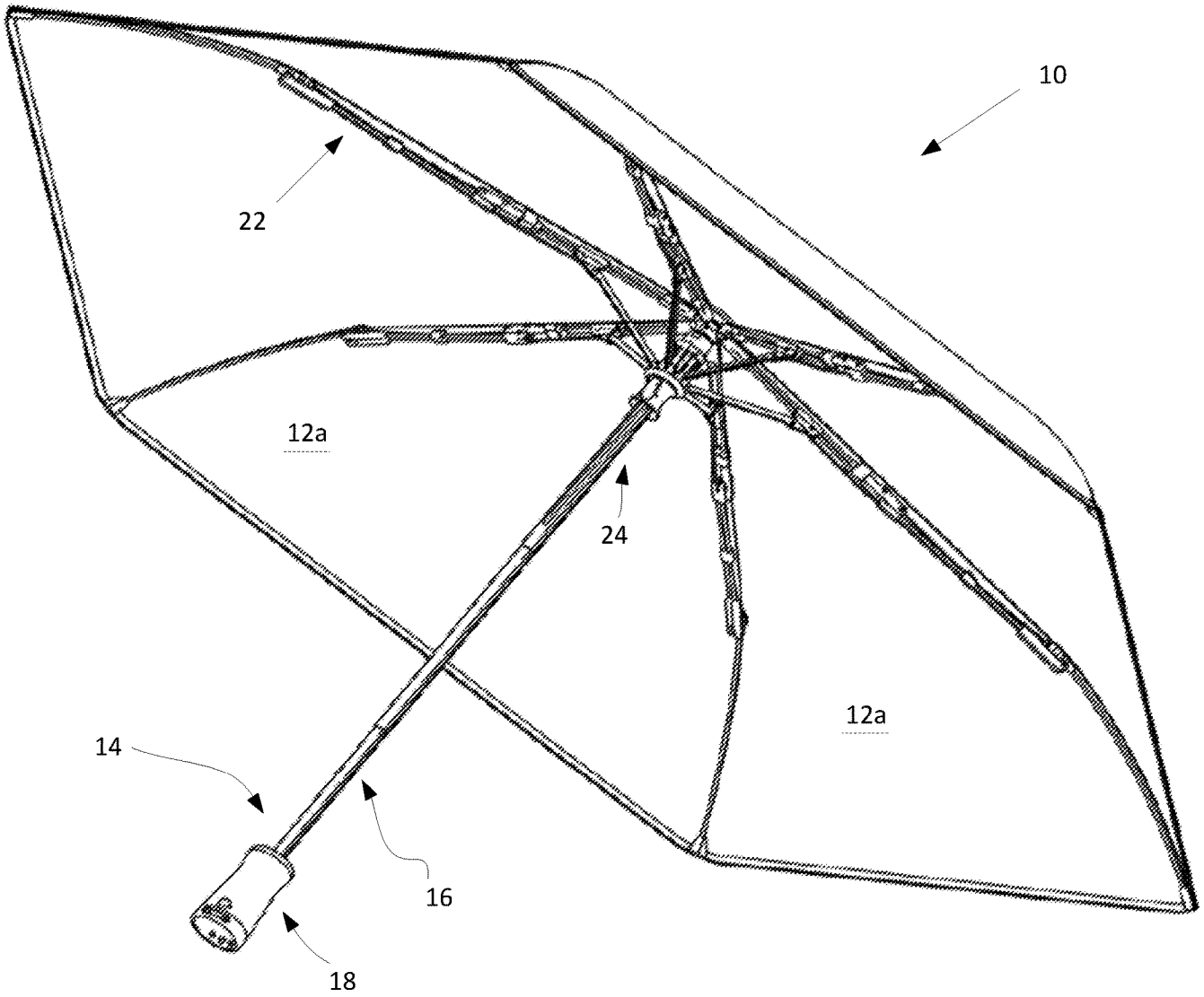
FIG. 1 is a perspective view of an umbrella in accordance with one embodiment of the disclosure.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The disclosure generally relates to a foldable wind-resistant umbrella. The umbrella includes a runner, or sliding, mechanism including a set of individual, independent ribs extending from the sliding mechanism and attached to the canopy of the umbrella. The set of ribs operate independent of each other such that when wind hits an underside of the canopy to which it is attached and/or adjacent, one or more rib structures, attached to or adjacent where the wind hits the canopy, move to counteract the force of the wind with the remaining ribs remaining stationary. As such, the wind force experienced by each independent rib is different. By having each rib structure move and operate independent of each other, there is less stress and strain on the independent rib structures and it less likely that the umbrella will flip inside out due to the wind. The independent rib structures provide an increased flexibility to the umbrella that raises the threshold necessary to flip the umbrella inside out.

Thus when the canopy of the umbrella is subject to wind or similar external forces, forces acting upon each rib do not translate to the other ribs. The present disclosure provides an umbrella with additional range of motion incorporated into the sliding collar assembly which provides each individual rib the ability to flex upon the application of wind force, reducing the forces transferred to adjacent ribs. This extra degree of rib motion allows the umbrella to maintain a hemi-spherical shape and thus creating a more aerodynamic profile. Ultimately, the independent movements of the ribs divert forces on the umbrella frame and canopy structure when encountering high winds.

Turning to FIG. 1, a perspective view of an umbrella is provided. The umbrella 10 includes a canopy 12 with multiple canopy portions 12*a* that are connected to a frame portion 14 of the umbrella 10. The canopy 12 is preferably made from a rain-protecting fabric.

The frame portion 14 includes a shaft, or shaft portion, 16 having a handle portion 18 at one end and a rib hub 20 at the other end. The frame portion 14 further includes a set of independent rib structures 22 that are connected to the rib hub 20 and a sliding, or slidable collar assembly 24. The sliding collar assembly 24 can be seen as the runner mechanism. As will be understood, the sliding collar assembly 24 slides along the shaft 16 allowing the frame portion 14 (or umbrella 10) to be moved between open and closed positions. As shown in FIG. 1, the umbrella 10 is in the open position. The sliding collar assembly 24 includes a locking mechanism (not shown) such that when the umbrella 10 is in the open position, the sliding collar assembly 24 (and frame portion 14) is locked in place. In order to close the umbrella 10, in one embodiment, the user can press on the locking mechanism to release the sliding collar assembly 24.

Each of the set of independent rib structures 22 is also connected at various locations to a canopy portion 12*a* and to the sliding collar assembly 24. This will be described in more detail below.

Figure 2:
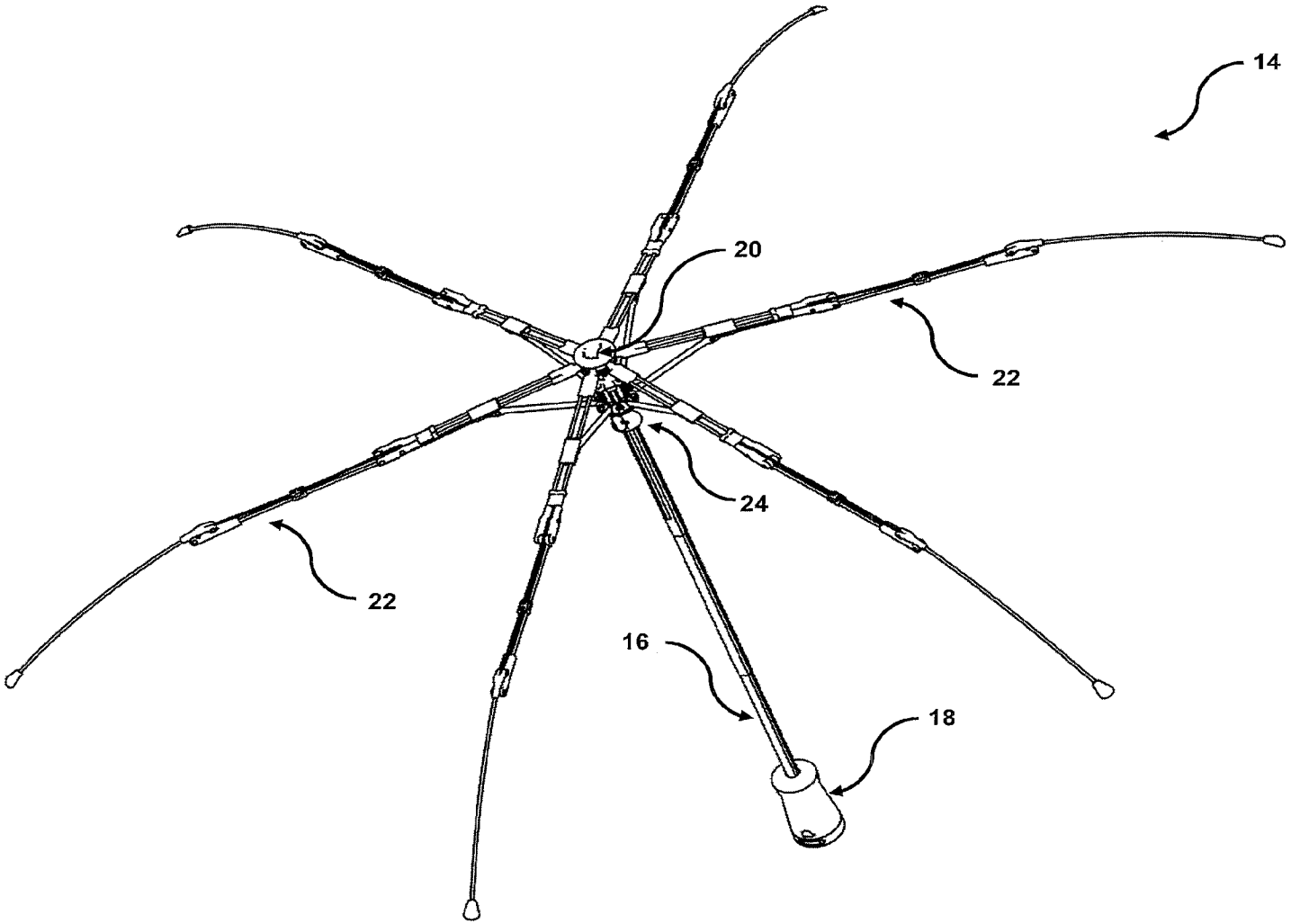
FIG. 2 is a perspective view of a frame portion for use with the umbrella of FIG. 1.
Figure 3:
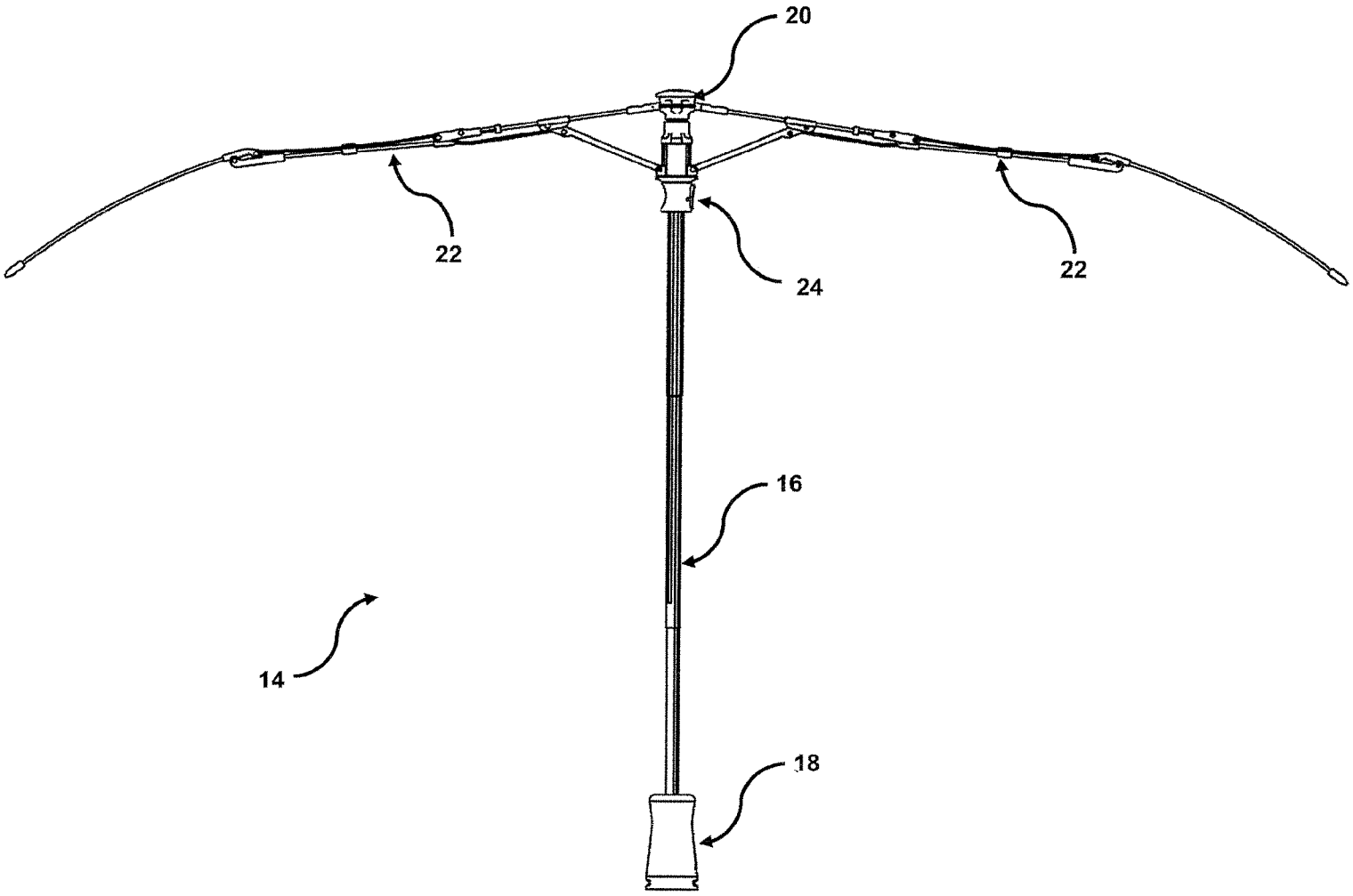
FIG. 3 is a side view of the frame portion of FIG. 2 with some ribs removed.
Figure 4:
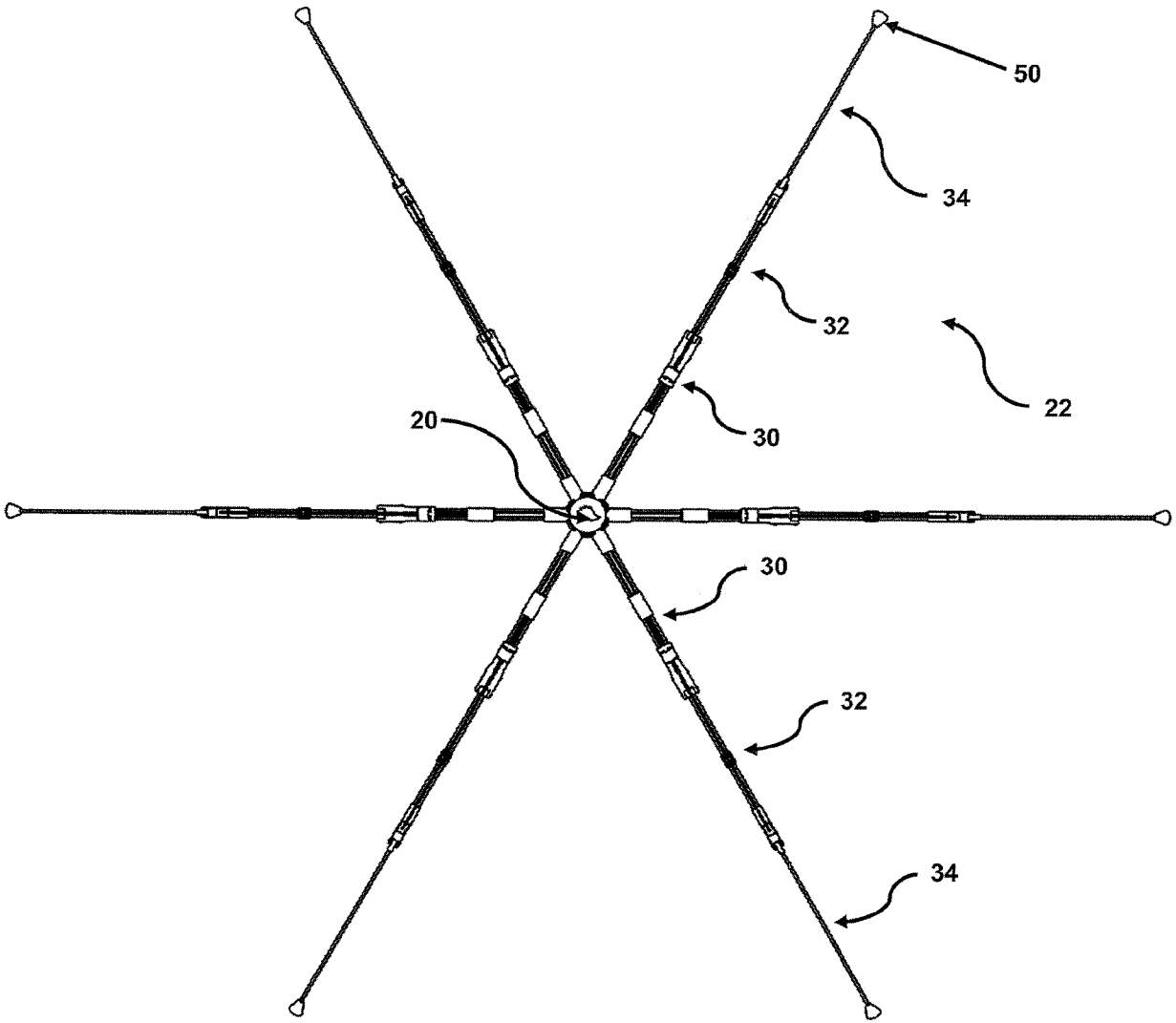
FIG. 4 is a top view of the frame portion of FIG. 2.

Turning to FIGS. 2 to 4, various views of the frame portion 14 (with the canopy removed) are provided. FIG. 2 is a perspective view of the frame portion 14, FIG. 3 is a side view of the frame portion 14 and FIG. 4 is a top view of the frame portion 14.

The handle portion 18 is attached to a bottom end of the shaft portion 16 and is used as an interface for a user to hold the umbrella 10 while in use. The top end of the shaft portion 16 is connected to the rib hub 20. In a preferred embodiment, the sliding collar assembly 24 is also connected to the shaft portion 16 and typically slides along the shaft portion 16.

In the current embodiment, the set of independent, and collapsible, rib structures 22 are radially disposed about the shaft portion 16 for suspending the canopy 12 of the umbrella 10 when in the open position. The radial disposition of the rib structures 22 provides an improved strength configuration as shown in FIG. 2. Each rib 22 is attached to the rib hub 20 and to the sliding collar assembly 24 to provide hinged movement of the independent rib structures 22.

In the embodiment shown in FIGS. 2 to 4, the umbrella 10 includes six independent rib structures 22, however, in alternative embodiments the umbrella 10 may include additional independent rib structures 22 or may include fewer than six independent rib structures 22. The rib structures 22 provide structural stability to the umbrella 10.

As can be seen in FIG. 4, each rib structure 22 includes a primary section 30, a middle section 32 and an end section 34. In the preferred embodiment, the independent rib structures 22 are preferably spaced equidistance apart whereby with six rib structures 22, there is approximately 60 degrees of separation between adjacent ribs 22. For other configurations, the spacing may be determined by dividing 360 by the number of ribs 22. Alternatively, other spacing setups may be contemplated as long as structural stability of the umbrella 10 is maintained.

Figure 6:
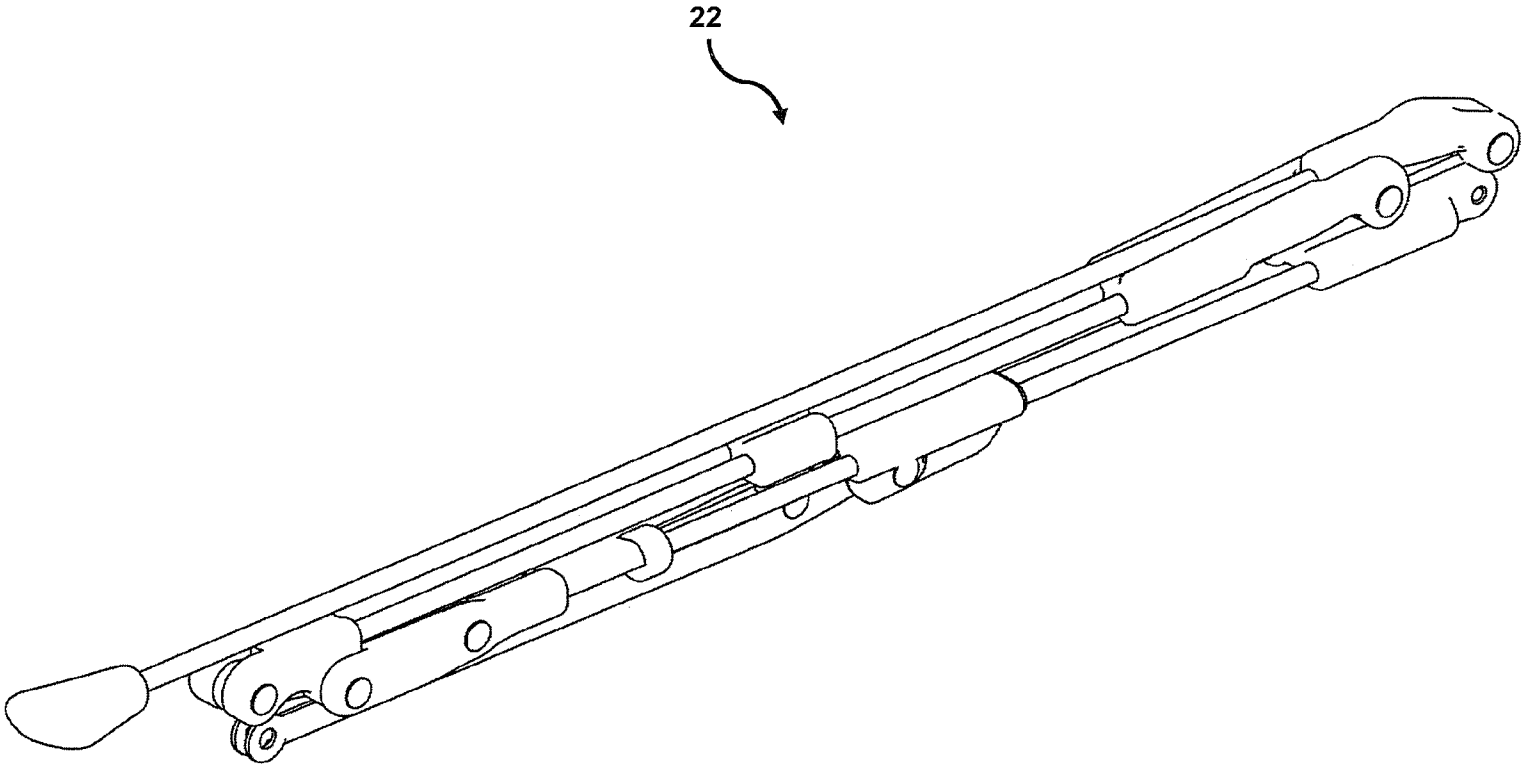
FIG. 6 is a perspective view of the rib structure in FIG. 5 in a closed position.
Figure 7:
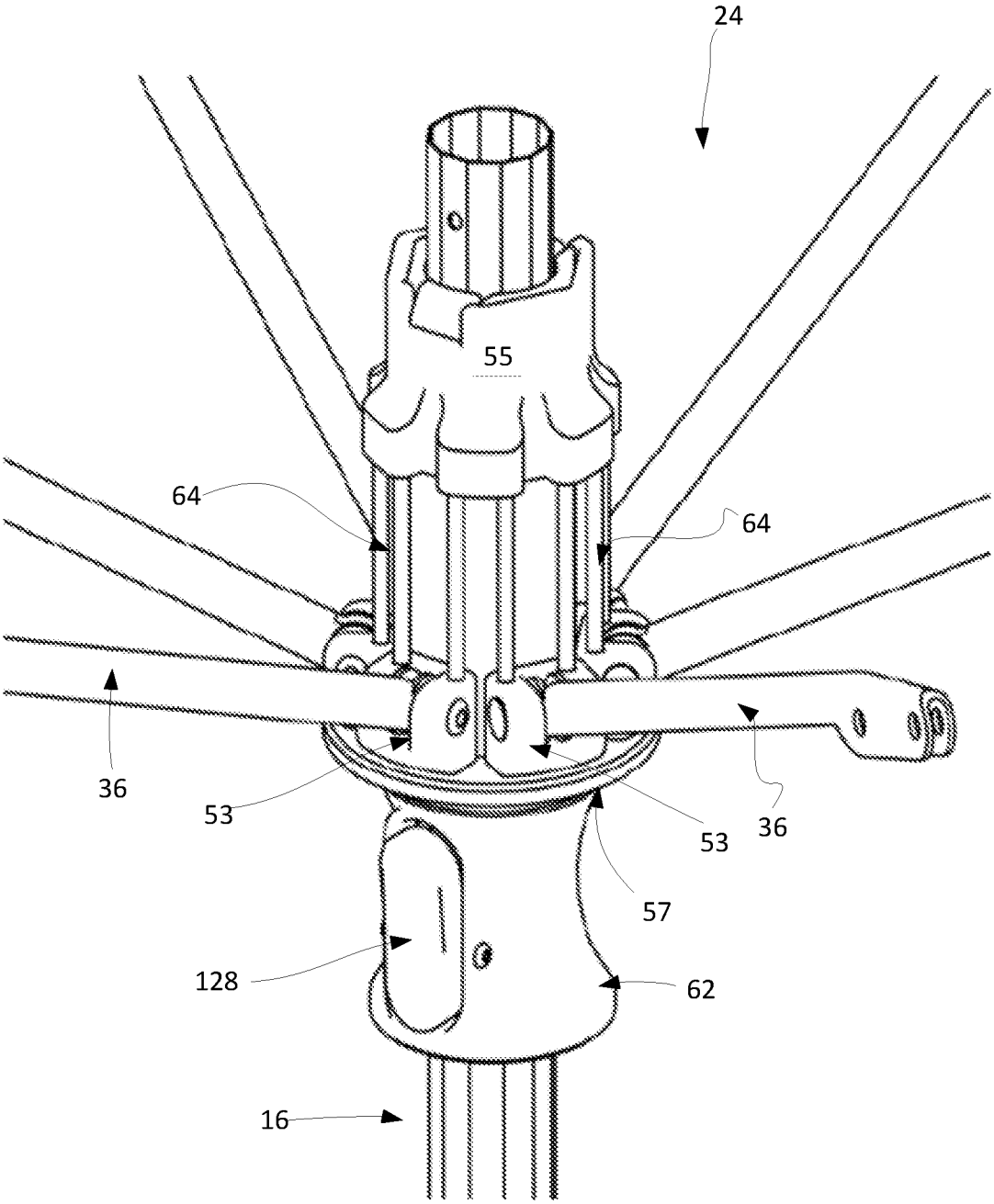
FIG. 7 is an enlarged view of a first embodiment of a sliding collar assembly.

In the open position, or configuration (as shown in FIG. 2), the independent rib structures 22 are folded outward, or extended, for suspending the canopy 12 of the umbrella 10 (such as shown in FIG. 1. When the independent rib structures 22 of the umbrella 10 are folded inward or folded together (such as shown in FIG. 6) the umbrella 10 is seen as being in the closed portion, or closed configuration.

Figure 5A:
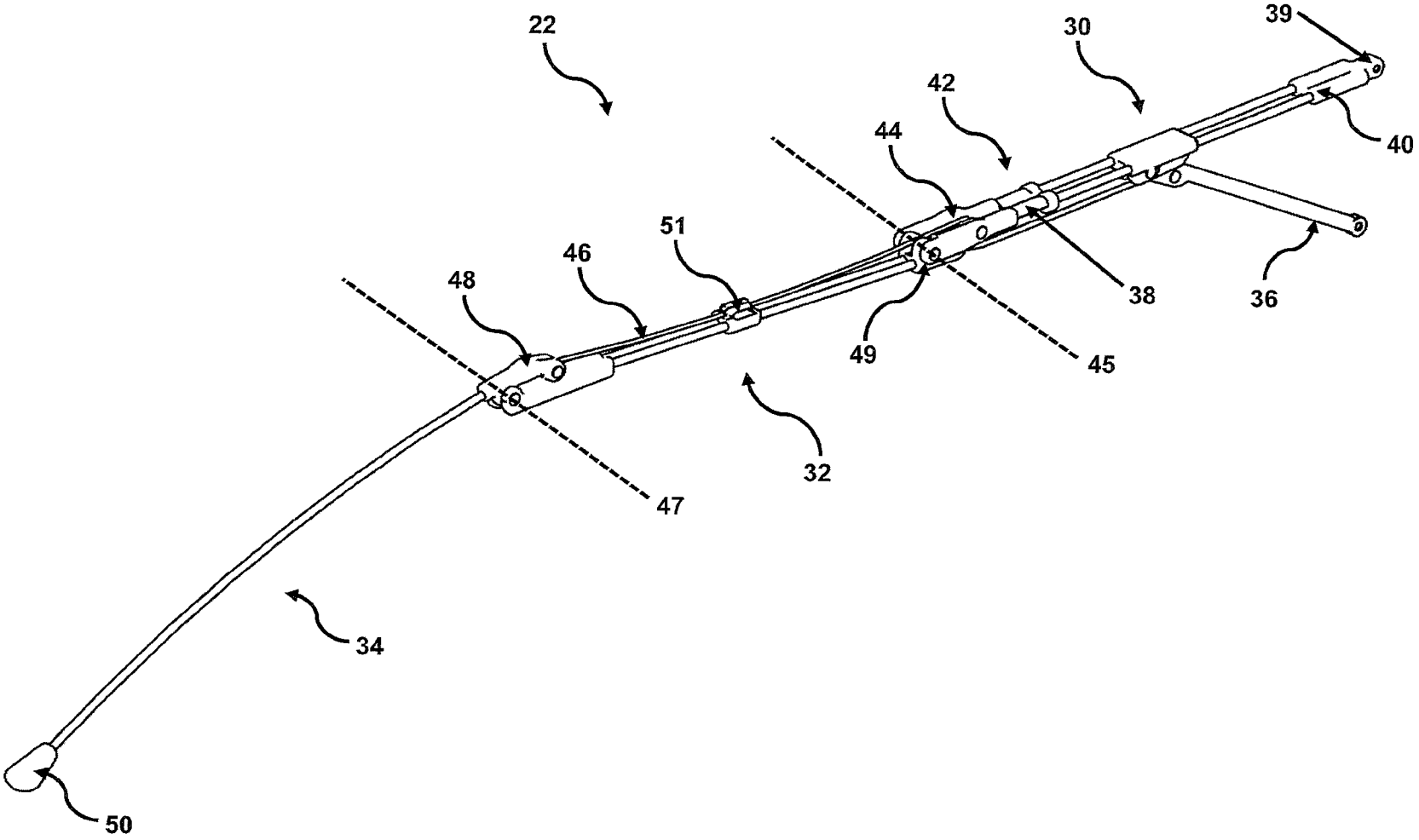
FIG. 5*a* is a perspective view of a rib structure of the frame portion of FIG. 2 in an open position.

Turning to FIG. 5*a*, a perspective view of an independent rib structure 22 is shown. As discussed above, the rib structure 22 includes the primary section 30, the middle section 32 and the end section 34. A support stretcher 36 is connected to the primary section 30 and extends away from the primary section 30. The primary section 30 further includes a support spring 38.

The primary section 30 may be seen as including an inner end 40 and an outer end 42 with the inner end 40 connected to the rib hub 20 and the outer end 42 connected to the middle section 32 via a first rib joint 44. Connection between the rib structure 22 and the rib hub 20 is shown in more detail in FIG. 5*a*.

Figure 5B:
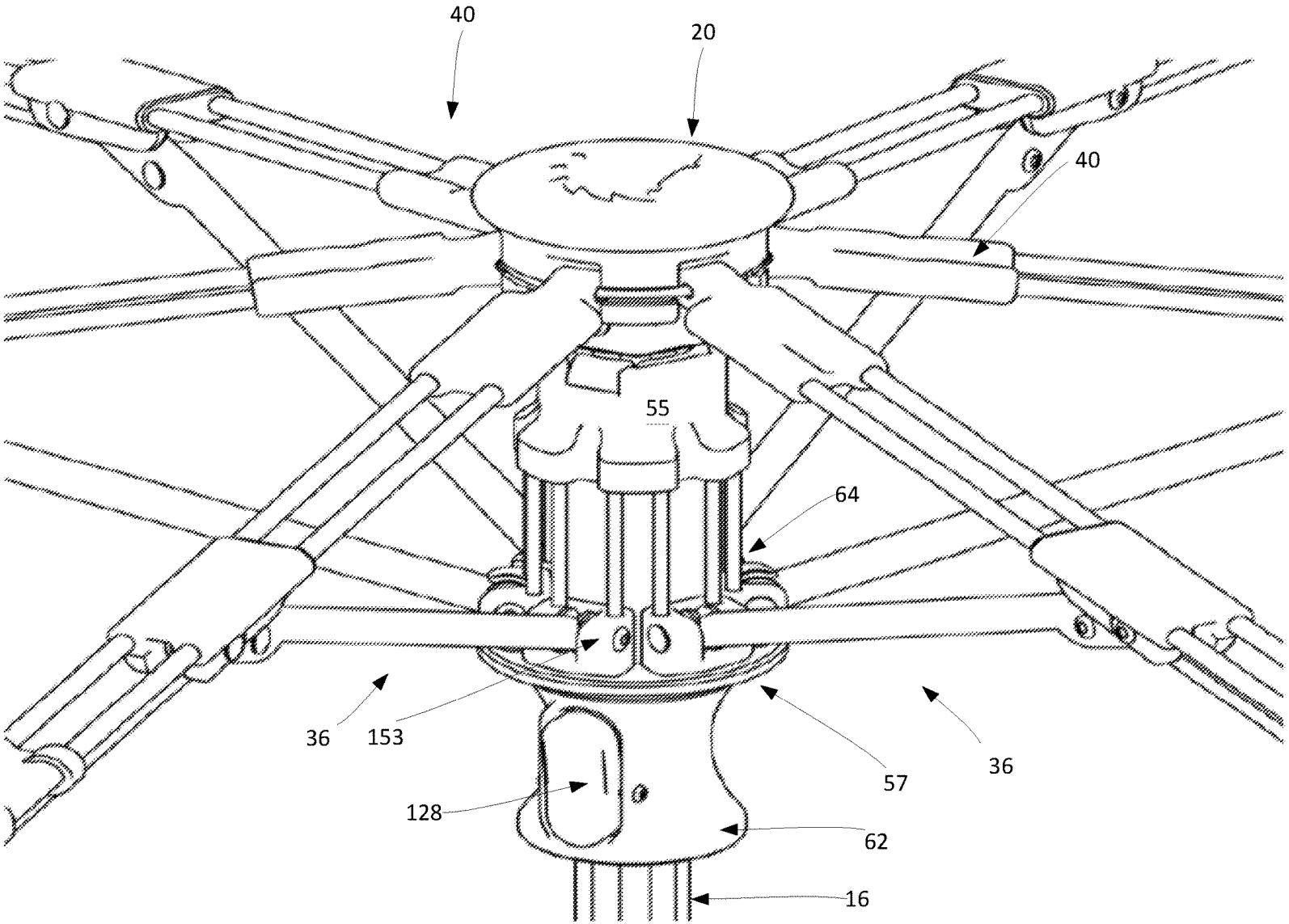
FIG. 5*b* is a perspective view of a top portion of the frame portion.

As can be seen in FIGS. 5*a* and 5*b*, a hole 39 (located in the inner end 40) receives a fastener, such as a wire, that holds the ribs 22 in place against the rib hub 20. Each support stretcher 36 is connected to a component, such as hinge 153, of the sliding collar assembly 24. This central connection of the ribs 22 allows the sliding collar assembly 24 to control each of the ribs to move the umbrella 10 between open and closed positions. Although the movement of the rib structures 22 may be seen as co-ordinated and centrally controlled, the ribs 22 move independent of each other. Due to the structure of each of the ribs structures 22, as outlined above, when a wind force hits the inside of one of the canopy portions 12*a*, the ribs structures 22 adjacent and/or connected to the canopy portion 12*a* at that location move independently of each other to absorb the wind force and to increase the threshold necessary to flip the umbrella inside out.

Turning back to FIG. 5*a*, the first rib joint 44 allows the primary section 30 to freely rotate about the middle section 32. The axis of rotation can be seen as line 45 of FIG. 5. The support stretcher 36 is pivotally connected to the primary section 30 along and adjacent a center of the primary section 30. The support spring 38 connects the support stretcher 36 to the middle section 32 via the first rib joint 44. In the current embodiment, the support stretcher 36, the primary section 30, the middle section 32 and the support spring 38 can be seen as a first linkage system. The support spring 38 further provides a guard to inhibit or reduce the likelihood that that middle section 32 rotates beyond an inversion point about the rotating axis 45 of the primary section 30 and middle section 32.

The middle section 32 further includes a main spring 46 which is attached to the end section 34 via a second rib joint 48. The end section 34 includes a rib tip 50 that is attached to the canopy 12. The second rib joint 48 is attached to the middle section 32 and is free to rotate about a connection axis (seen as line 47) at the second rib joint 48. The main spring 46 connects the outer end 42 of the primary section 30 to the second rib joint 48. The main spring 46 further provides a guard to inhibit or reduce the likelihood that that end section 34 rotates beyond an inversion point about the rotating axis 47 of the middle section 32 and end section 34. Along the center portion of the middle section 32 is a spring guide 51 which clips the main spring 46 at the center portion. This spring guide 51 further prevents the main spring 46 from flexing beyond the point of which the end section 34 can invert about axis 47. The primary section 30, the middle section 32, the second rib joint 48 and the main spring 46 may be seen as a second linkage section. In use, the main spring 46 preferably limits or reduces rotational motion of the second rib joint 48 relative to the middle section 32, which inhibits or reduces the likelihood that an individual rib structure 22 rotates beyond an inversion point about the rotating axis 47.

The end section 34 is connected to the middle section 32 via the end of the second rib joint 48 opposite the connection with main spring 46. When the umbrella 10 is in the open position, the end rib section 34 is pointed in an outward direction relative to the shaft portion 16. The end section 34 is preferably made of any suitable flexible material that allows the canopy of the umbrella 10 to arch in a curved hemispherical shape while the umbrella 10 is in the open configuration. At the outer end of the end section 34, the rib tip 50 attaches to the outer edge corners of a canopy portion 12*a* of the umbrella 10. In the closed configuration, the end section 34 reverts back to a straightened form such as schematically shown in FIG. 6 which shows how the rib structure 22 would look when the umbrella 10 is in the closed position. The components of each independent rib structures 22 can be made of any suitable metal. Alternatively, the components of each rib structure 22 may be made of any suitable plastic or some components may be made of metal and other components may be made of plastic.

Referring back to FIGS. 2 to 4 and 5*b*, each of the support stretchers 36 is pivotably connected to the sliding collar assembly 24. The sliding collar assembly 24 allows independent movement of the support stretchers 36 relative to the shaft 16, which changes the angular positions and pivoting points of the support stretchers 36. Through biasing an inner end point of the support stretchers 36, the displacement of the location of the inner end point of the support stretchers 36, changes the effective position and overall configuration of each rib structure 22 to an actuated state, allowing independent motion of individual independent rib structures 22, and allowing the umbrella 10 to maintain a hemi-spherical shape, and thus creating a more aerodynamic profile when opened in high wind conditions.

When the umbrella 10 is in the open configuration, the canopy 12 of the umbrella 10 stretches and is in tension, which causes the independent rib structures 22 to bend toward the shaft portion 16 and to act as a spring to maintain the arcing shape of the umbrella 10. With no wind or similar external force impact on the canopy of the umbrella 10, the independent rib structures 22 are in a static rest state. With independent rib structures 22 in the static rest state, the angular position of the support stretcher 36 relative to the shaft 16 is seen as being in a stable condition, and the location of the end point of the support stretcher 36 is at its lowest position relative to the sliding collar assembly 24. When high winds blow upward into or onto at least one of the canopy portions 12*a*, which reduces the tension on the canopy 12, the independent rib structures 22 are triggered which reduces the bending forces acting on the independent rib structures 22 (which are either attached and/or adjacent the canopy portion 12*a* or portions being affected) and causes the independent rib structures 22 to invert. The additional degree of motion provided by each support stretchers 36 (typically in an upward direction) provides each rib structure 22 extra travel before the rib structure 22 experiences bending forces. With the changeable angular position and location of the end point of the support stretcher 36, this displacement in the position of the support stretcher 36 lowers the overall bending of a respective rib structure 22 which reduces the likelihood of that the rib structure 22 will invert when the canopy portion 12*a* to which it is attached is subject to high wind forces.

As the movement of a rib structure 22 is independent to the movement of other independent rib structures 22, the support stretcher 36 travel will have no direct effect upon the support stretchers 36 of other independent rib structures 22. The change in angular positional and location of the end point of a support stretcher 36 is independent only to that of its respective rib structure 22. As such, some independent rib structures 22 can be referred to as being in an actuated position, while other independent rib structures 22 can remain in the static rest position, increasing stability of the umbrella 10 and reducing the likelihood of the umbrella 10 flipping inside out.

To enable the support stretcher 36 to return to the static rest position after high wind forces on the canopy portion 12*a* has subsided, the support stretcher 36 preferably has a pinned connection to a component (such as hinge 153) which can travel about the sliding collar assembly 24. This component requires individual guided travel about the sliding collar assembly 24 in a vertical and/or outward direction relative to the main shaft 16 which will change the angular position of the support stretcher 36. This is discussed in more detail below. To limit or reduce the travel distance, a top stopper 55 (FIG. 5*a*) may be used to limit or reduce upward travel distance while a bottom stopper 57 is used to limit or reduce downward travel distance whereby this may dictate upper and lower limits of the support stretcher 36 position.

Moving the support stretcher 36 upwards and/or away relative to the main shaft 16 brings the rib structure 22 to the top stopper 55 and to an upper peak position where the rib structure 22 begin to experience bending forces. Moving the support stretcher 36 downwards and closer relative to the shaft portion 16 brings the rib structure 22 to the bottom stopper 57 and to a lower peak position where the rib structure 22 returns to the static rest position.

Referring to FIGS. 7 to 10, various views of a first embodiment of a sliding collar assembly 24 for use with the umbrella 10 is shown. In the current embodiment, the sliding collar assembly 24 is coupled to the shaft portion 16 to slide along the shaft portion 16. The sliding collar assembly 24 includes a slider core 60 to which the support stretchers 36 of each of the rib structures 22 is connected. The slider core 60 includes an aperture or hole through which the shaft portion 16 runs through axially, allowing the sliding collar assembly 24 to be slidably mounted to the shaft portion 16 to allow free movement of the sliding collar assembly 24 along the shaft portion 16. When the umbrella 10 is in the open configuration, the slider core 60 is positioned along the shaft portion 16 at the upper peak position such that all expanded independent rib structures 22 maintain their extended formation. At the base of the slider core 60 is a slider knob 62 which is used as an interface to change the configuration of the umbrella 10 from the closed configuration to the open configuration, and vice versa, from open configuration to the closed configuration by moving the slider knob 62 up and down the shaft portion 16. The sliding collar assembly 24 includes a locking mechanism within the slider knob 62 that includes a button 128 that serves to unlock the locking mechanism. In use, after the sliding collar assembly 24 has been urged past a locking point (whereby the umbrella 10 is in the open position), in order to return the umbrella 10 to the closed position, the user presses the button 128 in order to release the locking mechanism whereby the sliding collar assembly 24 can then be slid down the shaft 16 to close the umbrella 10.

Guide rails 64, attached to the bottom stopper 57, serve as a guiding mechanism which runs substantially parallel to the axis of the slider core 60. The guide rails 64 are secured in between the bottom stopper 57 and a top stopper 55. Installed along the guide rails 64 are slider shuttles 53 which move freely along the guide rails 64. The top stopper 55 limits or reduces upward travel of the slider shuttles 53 while the bottom stopper 57 limits or reduces the downward travel of the slider shuttles 53. The support stretcher 36 of each rib structure 22 is coupled to a slider shuttle 53, using for example, a pin. Changing the vertical position of slider shuttle 53 relative to the slider core 60 adjusts the effective position of the support stretcher 36 in order to accommodate any unwanted or undesired forces applied to the canopy 12.

To change the umbrella 10 from the closed to open configuration, the sliding collar assembly 24 is moved to the upper peak position along the shaft portion 16. At the upper peak position of the sliding collar assembly 24 along the shaft 24, the independent rib structures 22 are stretched out to its open configuration to expand the umbrella canopy 12 to its open configuration. When the rib structures 22 are not actuated, all the slider shuttles 53 are in the static, or rest, position and the sliding collar assembly 24 is positioned along the shaft portion 16 at the upper peak position to maintain the umbrella 10 in the open configuration.

Figure 8:
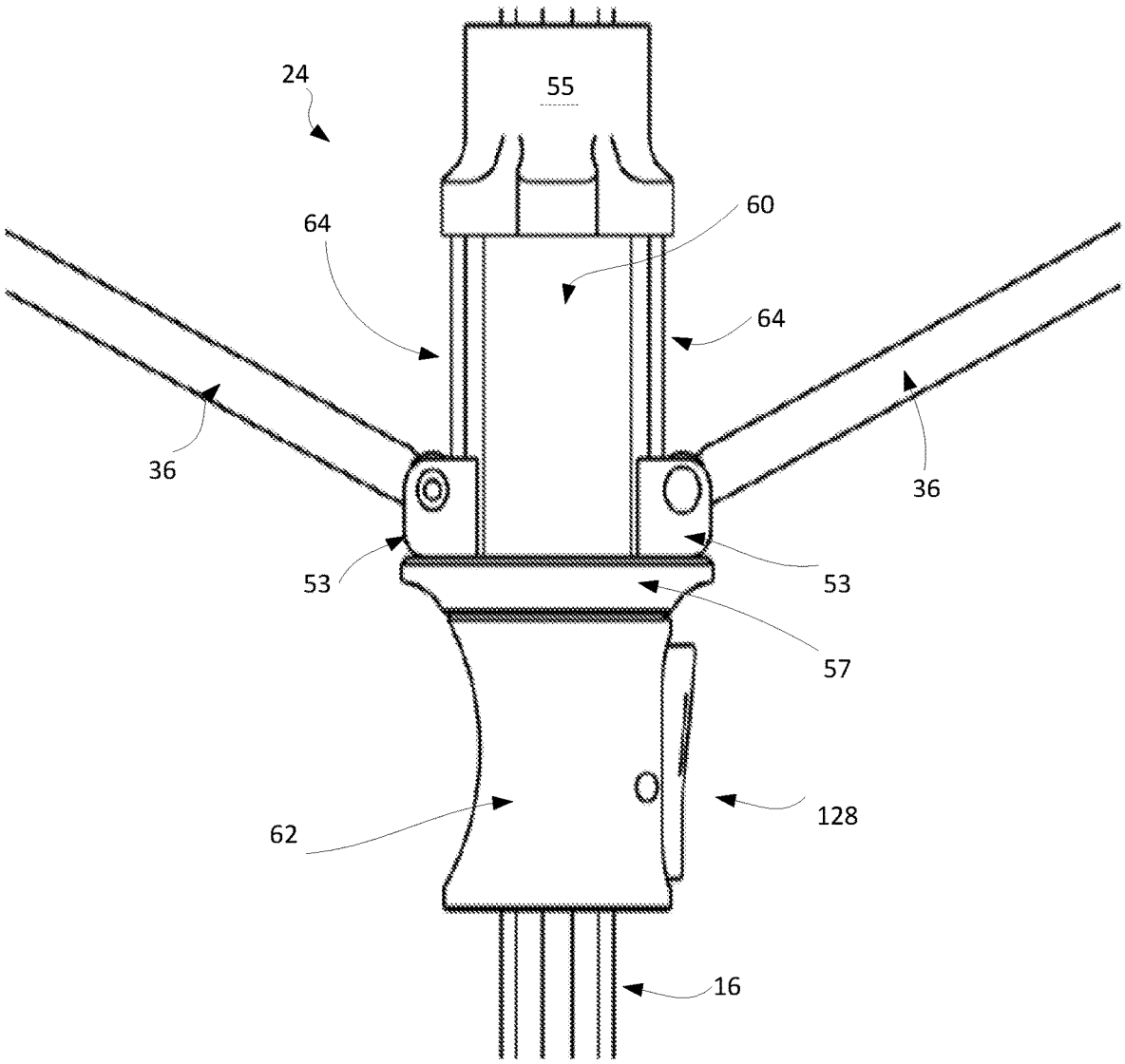
FIG. 8 is a side view of the sliding collar assembly of FIG. 7 with ribs in a resting position.

FIG. 8 shows the umbrella 10 in the open configuration with the sliders shuttles 53 at a rested position against the bottom stopper 57. In FIG. 8, some of the ribs have been removed to simplify the figure and for clarity of view. In the rested position, the slider shuttles 53 are at the lowest position with respect to the guide rails 64 due to the bending forces of the canopy 12 and rib structure 22 which pushes the support stretcher 36 in a downward direction. The bottom stopper 57 in this configuration limits further travel of the slider shuttles 53 in the downward direction along the guide rails 64.

Figure 9:
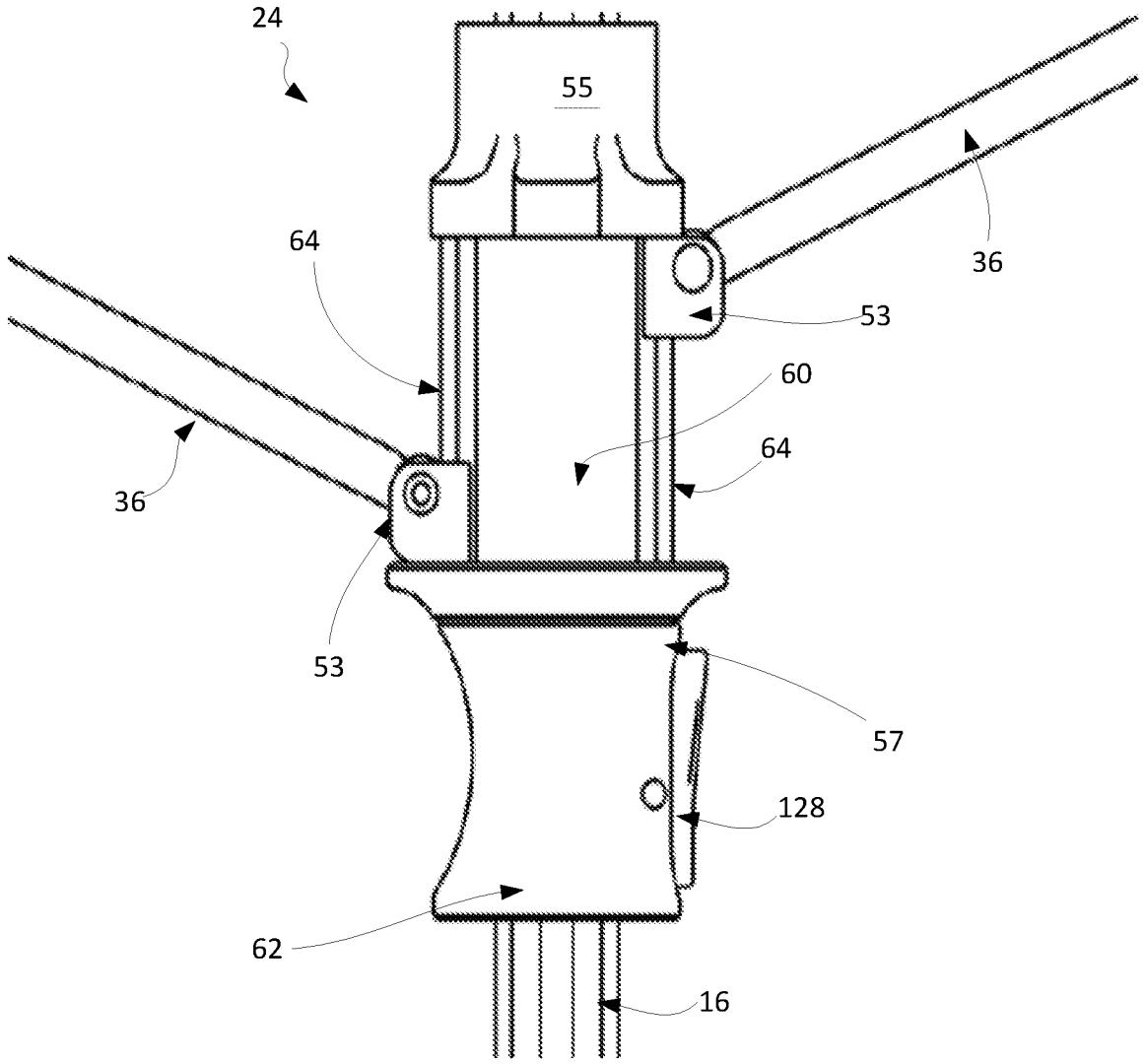
FIG. 9 is a side view of the sliding collar assembly of FIG. 8 with one rib in an actuated position.

When the canopy 12, or one of the canopy portions 12*a*, of the umbrella 10 is subject to high winds or similar external forces, the force applied to the canopy portion 12*a* may trigger the associated, or connected, rib structure 22 to which the canopy portion is attached to. FIG. 9 depicts a support stretcher 36 of a rib structure 22 (e.g. the support stretcher 36 located at the right of the sliding collar assembly 24) at the upper travel limit which is caused when the rib structure 22 reacts to the force applied to the canopy portion 12*a* that it is attached to. The independent movement of the slider shuttle 53 associated with this rib structure 22 provides support to the canopy portion 12*a* in order to handle the applied force. By having independent rib structures 22, the other ribs 22 remain in the static position.

As such, another rib structure 22 (e.g. the rib structure 22 at the left of the sliding collar assembly 24) remains in the rest position as the individual movements of one rib structure 22 do not directly affect the movements of other independent rib structures 22. As shown in FIG. 9, the actuated right support stretcher 36 and slider shuttle 53 are at the upper travel limit along the guide rails 64. This travel distance of the rib structure 22 is dictated by the distance between the bottom stopper 57 and top stopper 55. The actuation of the rib structure 22 and resultant movement of the attached slider shuttle 53 does not affect the movement of other slider shuttles 53. The individual movements of the slider shuttles 53 reduce the likelihood of the rib structure 22 bending beyond its inversion limit and decreases the tendency of the umbrella 10 from flipping inside out when the canopy 12 is subject to high wind forces and reduces the likelihood of damage to the frame portion 14 or umbrella 10. It will be understood that left and right as simply being used to facilitate understanding of the drawing and that there are no left or right ribs 22 or support stretchers 36 within an umbrella 10.

Figure 10:
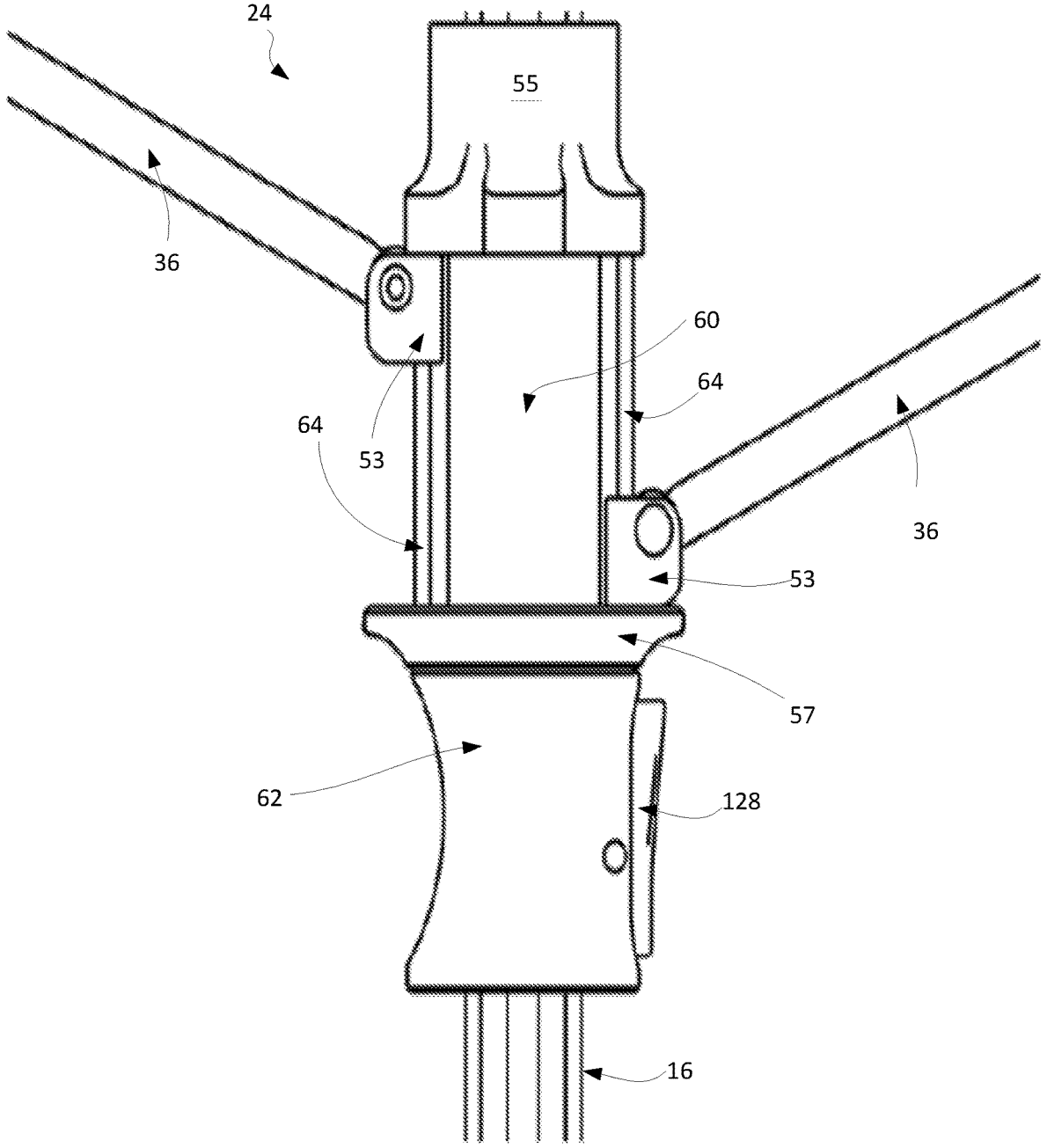
FIG. 10 is another side view of the sliding collar assembly of FIG. 8 with a second rib in an actuated position.

FIG. 10 shows a side view where the left support stretcher 36 is actuated while the right support stretcher 36 remains in the rest position. In FIG. 10, the left support stretcher 36 and respective slider shuttle 53 are at the upper travel limit along the left guide rail 64 to the rib structure 22 reducing inversion and reduces the likelihood of the canopy portion 12*a* from flipping inside out. In this instance, the actuation of one rib structure 22 still does not affect the movement of the other support stretchers 36 and slider shuttles 53. As will be understood, if an upward force is applied to the entire canopy, all of the rib structures 22 may be triggered to assist in dealing with the undesired forces. When multiple independent rib structures 22 are actuated simultaneously, the independent rib structures 22 still benefit from the additional range of motion afforded by the support stretchers 36, which reduces the likelihood of the umbrella 10 to flip inside out.

Figure 11:
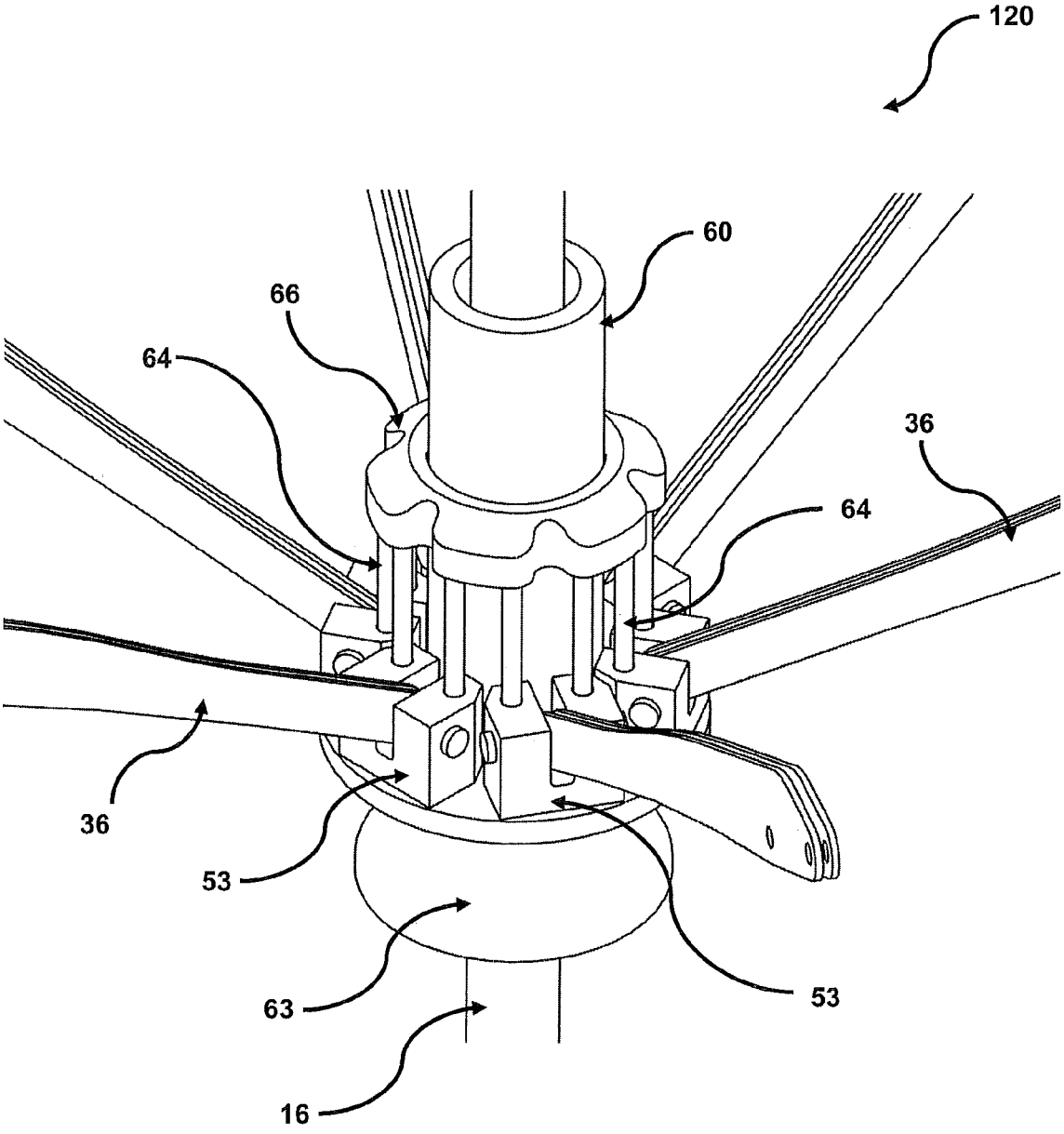
FIG. 11 is another embodiment of a sliding collar assembly.
Figure 12:
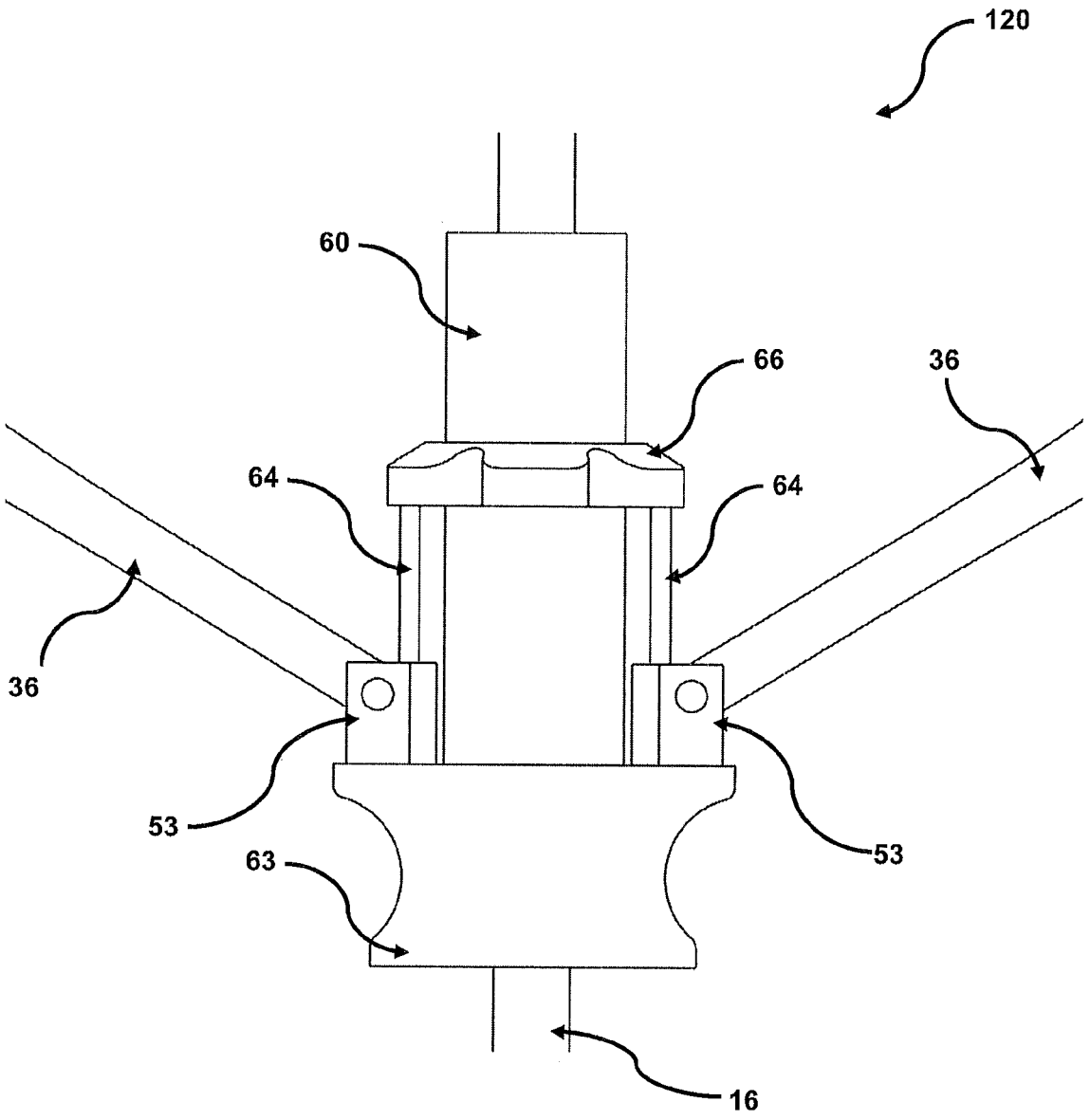
FIG. 12 is a side view of the sliding collar assembly of FIG. 11.
Figure 13:
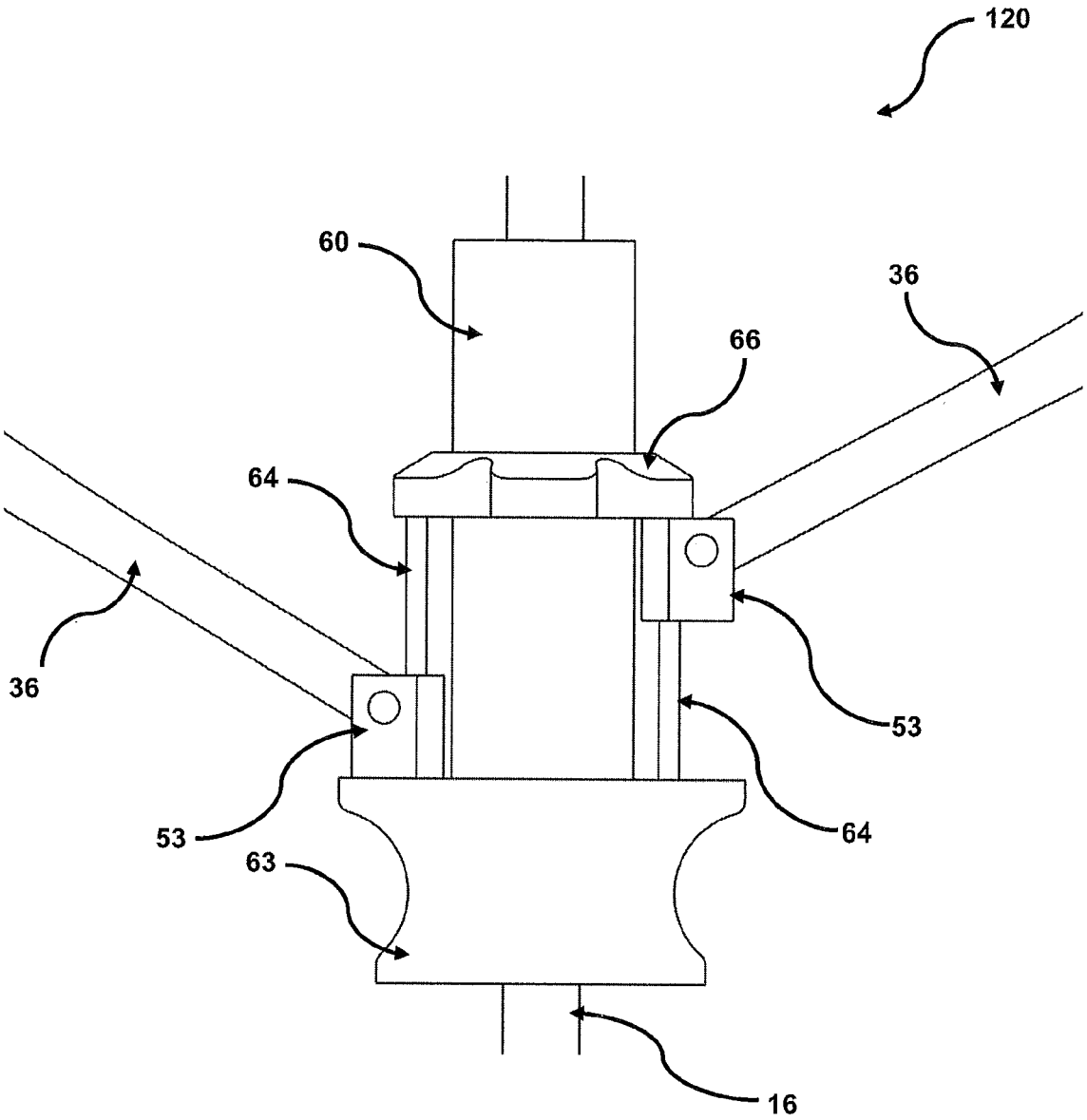
FIG. 13 is a side view of the sliding collar assembly of FIG. 11 with one rib actuated.

Turning to FIGS. 11 to 13, further views of another embodiment of a sliding collar assembly are shown. In some of these Figures, some of the ribs 22 have been removed to simplify the figure and for clarity of view. The sliding collar assembly 120 includes a slider core 60 and slider knob as described above. In this embodiment, the sliding collar assembly 120 is similar to the one shown in FIGS. 7 to 10 with the difference being the design of the slider knob. In the current embodiment, the sliding collar assembly 120 includes the bottom stopper 63 and the top stopper 66. The sliding collar assembly 120 includes a bottom stopper 63 which also serves as a slider knob of which a user can interface with the umbrella 10 to actuate from open to close and vice versa. In the current embodiment, a locking mechanism is not shown. However, an external locking mechanism may be contemplated. FIG. 12 provides a side view of from the slider collar assembly 120 with all ribs 22 in a rested position and FIG. 13 provides a side view of the sliding collar assembly 120 of FIG. 11 with a rib 22 in an actuated position.

Figure 14:
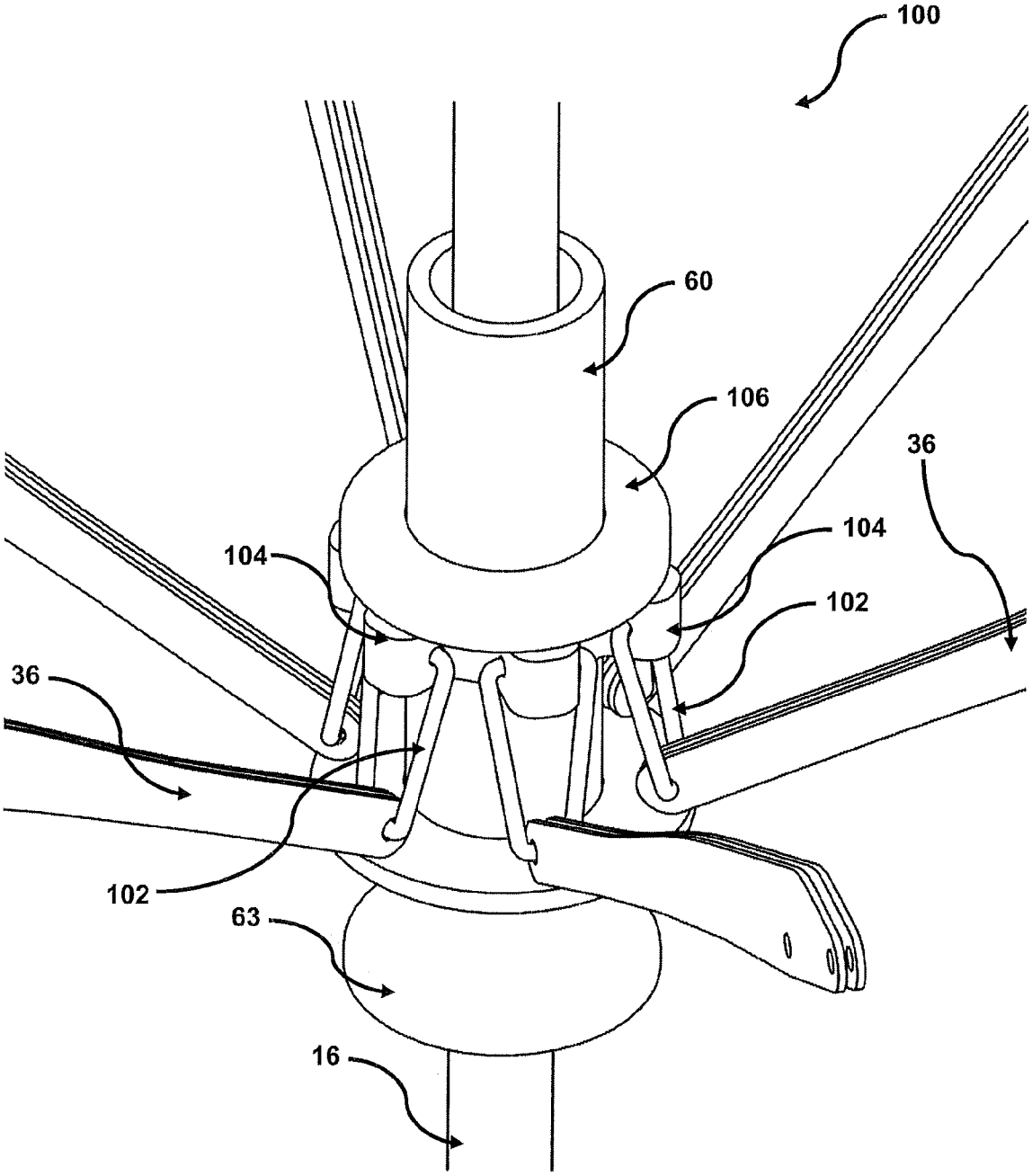
FIG. 14 is a perspective view of another embodiment of a sliding collar assembly.
Figure 15:
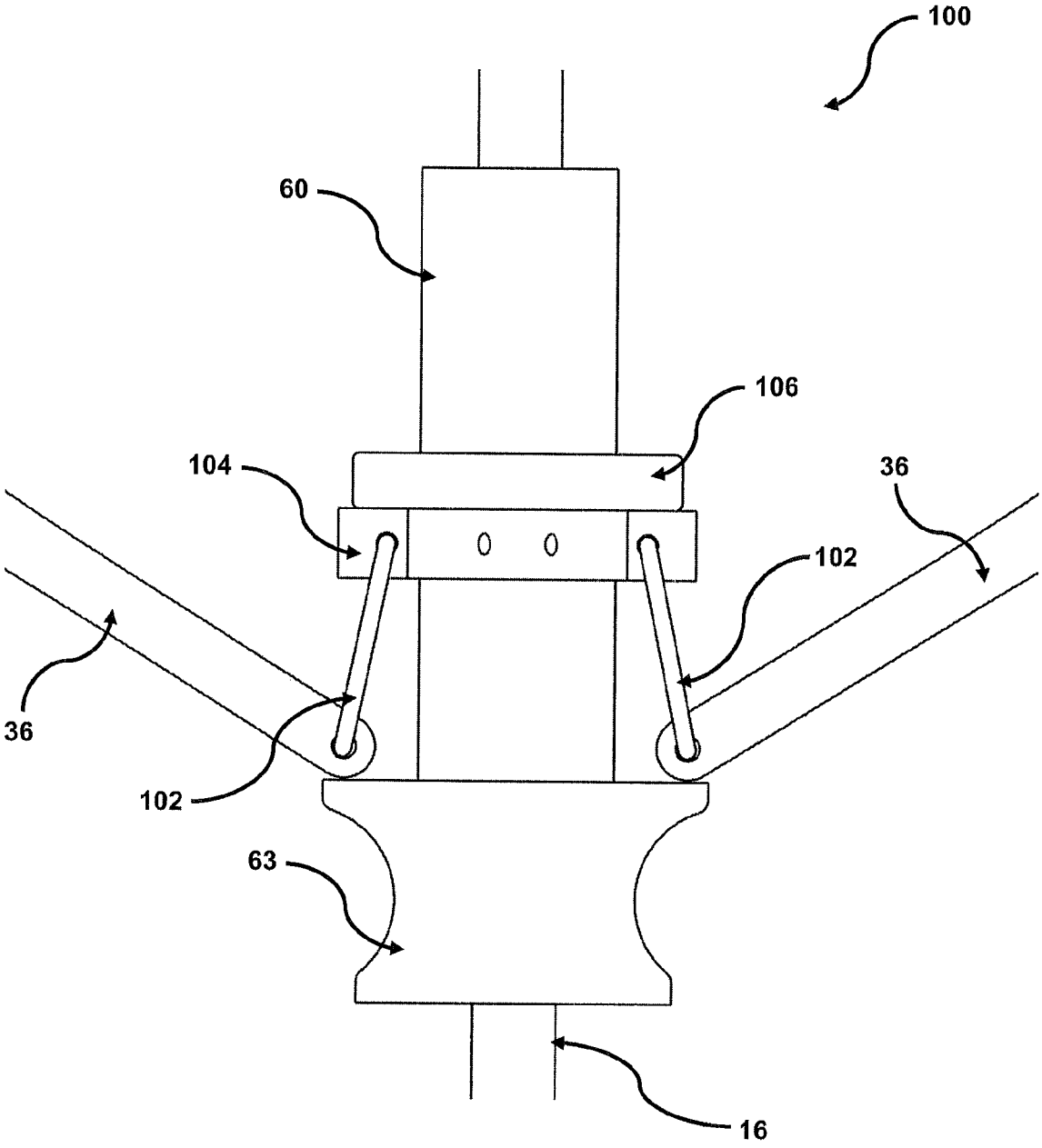
FIG. 15 is a side view of the sliding collar assembly of FIG. 14.
Figure 16:
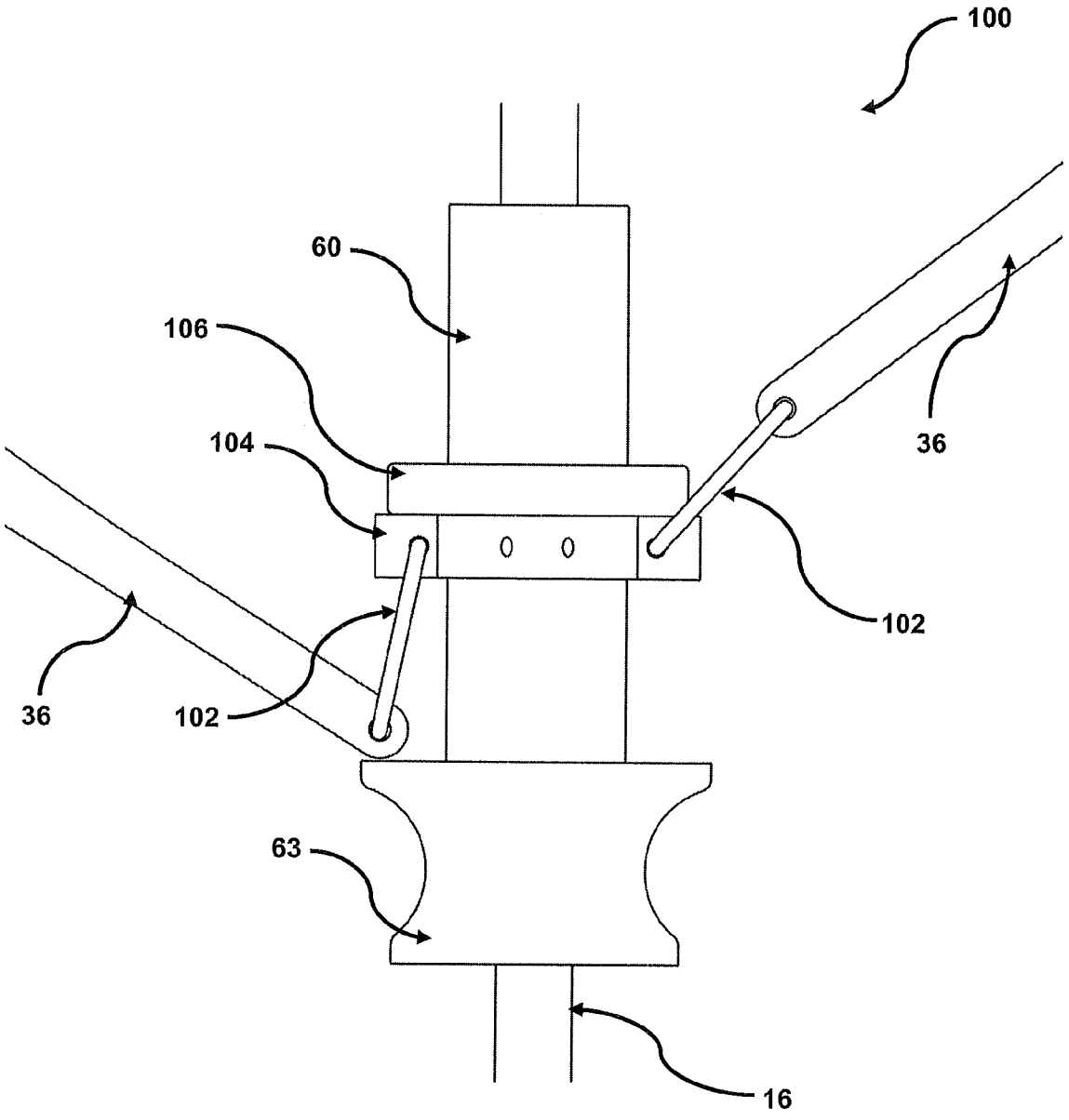
FIG. 16 is a side view of the sliding collar assembly of FIG. 14 with one rib actuated.

FIGS. 14 to 16 show another example embodiment of a sliding collar assembly 100 of the umbrella 10. In some of the Figures, some of the ribs 22 have been removed to simplify the figure and for clarity of view. The sliding collar assembly 100 includes a slider core 60 and slider knob as described above. The sliding collar assembly 100 also includes support clips 102 instead of slider shuttles 53. Installed along the upper region of the slider core 60 is a hook plate 104 which pivots the inner ends of support clips 102 allowing the support stretchers 36 to move when necessary. The combination of the support clips 102 and the hook plate 104 may represent the mechanism allowing the support stretches 36 to move in an upward or downward direction, when necessary, as outlined above. The support clips 102 are coupled at one end to the support stretchers 36, for example, using a pin, whereas the other end of the support clip 102 pivots about the hook plate 104 allowing free rotation which changes the location of end point of the respective support stretcher 36. As such, the movement of the support stretcher 36 end point adjusts the effective support stretcher 36 position reducing the likelihood of the rib structure 22 and resulting canopy 12 from flipping inside out. As such, the movement of the individual support clips 102 may provide the upper and lower limits of movement as described above.

Referring to FIG. 15, the sliding collar assembly 120 is shown with the umbrella 10 in the open configuration and the support stretchers 36 in a rested position in which the support stretchers 36 are resting against the slider knob. The slider knob serves as the bottom stopper 63 which reduces or inhibits the likelihood of the support clip 102 moving downwards by reducing or limiting the allowable rotation of the support clip 102. Installed on top of the hook plate 104 is a bumper 106 that limits upward travel of the support stretcher 36 by physically blocking or inhibiting the support clip 102.

Referring to FIG. 16, the sliding collar assembly 100 is shown with one support stretcher 36 (e.g. the support stretcher 36 on the right side of the sliding collar assembly 100) actuated. The right side support stretcher 36 is actuated when the corresponding rib structure 22 that includes the support stretcher 36 is actuated. The support stretcher 36 on the left side of the sliding collar assembly 100 is depicted in a rested position. In FIG. 16, the right side support stretcher 36 is at the upper travel limit of that dictated by the rotation of the support clip 102. The rotation limit is provided by the support clip 102 being stopped by the slider bumper 106 blocking the support stretcher 36 from moving into a position beyond the spring back limit.

The scope of the claims should not be limited by the embodiments set forth in the above examples, but should be given the broadest interpretation consistent with the description as a whole.

The above-described embodiments are intended to be examples only. Alterations, modifications and variations can be effected to the particular embodiments by those of skill in the art without departing from the scope of intended protection.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure.

In the preceding description, for purposes of explanation, numerous details are set forth in order to provide a thorough understanding of the embodiments. However, it will be apparent to one skilled in the art that these specific details may not be required. In other instances, well-known structures may be shown in block diagram form in order not to obscure the understanding.

What is claimed is:

1. An umbrella comprising:
- a canopy having a set of canopy portions; and
- a frame portion comprising:
  - a shaft portion;
  - a sliding collar assembly coupled to the shaft portion and sliding along the shaft portion;
  - a set of ribs, each rib of the set of ribs attached to one of the set of canopy portions and to the sliding collar assembly, where each rib of the set of ribs move independently of each other when a high wind force is experienced by one of the canopy portions; and
  - a set of support stretchers, each support stretcher of the set of support stretcher is associated with and connected to an end of one rib of the set of ribs in a one-to-one relationship;
- wherein the sliding collar assembly includes:
  - a set of guide rails; and
  - a set of slide shuttles, each slide shuttled associated with two guide rails from the set of guide rails each of the slide shuttles for receiving one of the support stretchers of the set of support stretchers.

2. The umbrella of claim 1 wherein each of the ribs comprise:
- a primary section having an inner end and an outer end;
- a middle section; and
- an end section;
- wherein each support stretcher of the set of support stretchers is connected at one end to the primary section of the rib to which it is associated and at a second end to the sliding collar assembly.

3. The umbrella of claim 2 wherein the sliding collar assembly comprises:
- a top stopper plate for blocking movement of the set of sliding shuttles in an upward direction; and
- a bottom stopper plate for blocking movement of the set of sliding shuttles in a downward direction.

4. The umbrella of claim 3 wherein when each end section comprises an end tip attached to the canopy portion.

5. The umbrella of claim 4 wherein when an undesired force is applied to one of the canopy portions, a support stretcher associated with the rib that is associated with the one of the canopy portions moves up a guide rail associated with the support stretcher to accommodate the undesired force.

6. The umbrella of claim 5 wherein the support stretchers associated with ribs adjacent the one canopy portion experiencing the undesired force move up guide rails associated with the support stretchers to accommodate the undesired force.

7. The umbrella of claim 1 wherein the shaft portion comprises:

a handle portion at one end; and a rib hub at an opposite end.

8. The umbrella of claim 7 wherein the rib hub comprises a fastening mechanism for fastening the rib hub to each of the set of ribs.

9. The umbrella of claim 7 wherein the sliding collar assembly comprises:

a locking mechanism.

10. The umbrella of claim 9 wherein the locking mechanism is an internal locking mechanism.

11. The umbrella of claim 1 wherein the set of ribs are radially disposed about the shaft portion.

12. The umbrella of claim 11 wherein the set of ribs are spaced an equidistance apart.

* * * * *